US005093865A

United States Patent [19]

Smith

[11] Patent Number: 5,093,865

[45] Date of Patent: Mar. 3, 1992

[54] REFLECTING SOUND IMAGING SPEAKER ENCLOSURE

[76] Inventor: Scott G. Smith, 241 Gregg St., Streamwood, Ill. 60107

[21] Appl. No.: 558,565

[22] Filed: Jul. 27, 1990

Related U.S. Application Data

[63] Continuation-in-part of Ser. No. 306,787, Feb. 6, 1989, abandoned.

[51] Int. Cl.[5] ..... H04R 1/02

[52] U.S. Cl. ..... 381/90; 381/186; 381/188; 381/205; 181/179

[58] Field of Search ..... 381/88, 89, 90, 188, 381/24, 205, 63; 181/144, 145, 155, 156, 176, 199, 179

[56] References Cited

U.S. PATENT DOCUMENTS 4,908,601 3/1990 Howze ..... 381/186

*Primary Examiner*—Forester W. Isen

[57] ABSTRACT

The direct and reverberant sound fields heard at a live musical performance are reproduced by a speaker enclosure consisting of two sub-enclosures mounted on a base with each subenclosure housing at least one speaker, thereby realistically reproducing the music.

3 Claims, 1 Drawing Sheet

REFLECTING SOUND IMAGING SPEAKER ENCLOSURE

This application is a continuation-in-part of Ser. No. 07/306,787, filed Feb. 6, 1989, now abandoned.

BACKGROUND OF THE INVENTION

1. Field of the Invention

The invention relates generally to a device for reproducing the direct sound field and the reverberant sound field heard at a live musical performance.

2. Description of the Prior Art

It is commonly known that for natural-sounding reproduction of music both the direct and the reverberant sound fields present at a live musical performance must be reproduced in reasonably proper proportions. Some speaker enclosures currently in use utilize separate speakers to reproduce the direct and reverberant sound fields. The invention herein described uses the same speakers to reproduce, in a new way, both the direct and reverberant sound fields, thereby resulting in a potentially lower overall number of speakers and reduction in cost compared to existing designs.

SUMMARY OF THE INVENTION

The invention relates generally to a device to reproduce both the direct and the reverberant sound fields associated with the performance of live music. The direct sound field provides the sound reaching the listener directly from the musical instruments, vocalists, or other sound sources enabling localization of the sound sources. The reverberant sound field is the sound reflected from the walls, ceilings, floors, or other objects surrounding the sound sources before reaching the listener. Reproduced music which does not adequately reproduce the reverberant sound field does not sound natural, but rather harsh or shrill.

The invention is a speaker enclosure consisting of two sub-enclosures mounted on a base with each sub-enclosure housing at least one speaker which uses sound reflected from an external reflecting member, such as a wall, behind the speaker enclosure to reproduce both the direct and the reverberant sound fields.

DESCRIPTION OF THE PREFERRED EMBODIMENT

Figure 1:
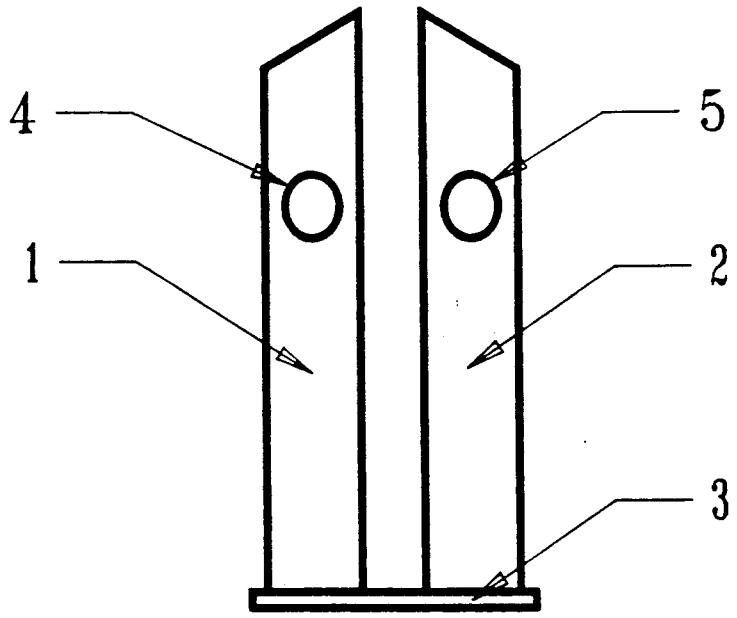
FIG. 1 is a rear elevation view showing an embodiment of the Reflecting Sound Imaging Speaker Enclosure.
Figure 2:
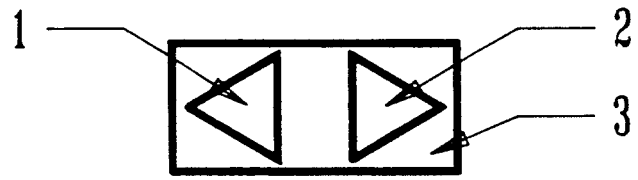
FIG. 2 is a plan view of the embodiment of the Reflecting Sound Imaging Speaker Enclosure.
Figure 3:
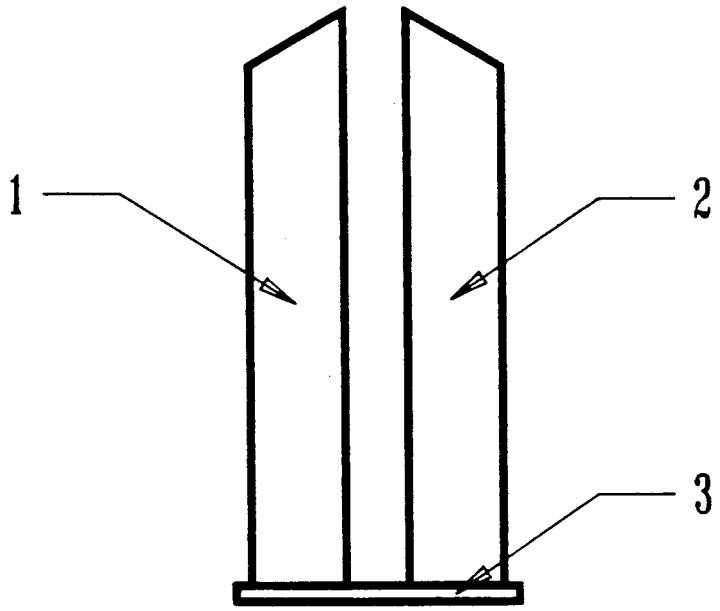
FIG. 3 is a front elevation view of the embodiment of the Reflecting Sound Imaging Speaker Enclosure.

Referring to FIGS. 1, 2, and 3, an embodiment of the Reflecting Sound Imaging Speaker Enclosure is shown. In this embodiment, the Reflecting Sound Imaging Speaker Enclosure is comprised of sub-enclosure 1 and sub-enclosure 2 mounted on base 3, sub-enclosure 1 housing at least one speaker 4 and sub-enclosure 2 housing at least one speaker 5, forming an opening which allows a portion of the sound reflected from the wall or walls behind the Reflecting Sound Imaging Speaker Enclosure to pass through the Reflecting Sound Imaging Speaker Enclosure. This sound is dispersed into the listening area by means of diffraction caused by the sound passing through the opening formed by sub-enclosure 1 and sub-enclosure 2 mounted on base 3, thereby reproducing the direct sound field, as described previously herein. This opening is meant to be small enough to effectively refract a relatively wide range of frequencies into a useful dispersion pattern aimed at the listening area. A typical practical value for the width of this opening is two inches. As the width of the opening is increased, the range of frequencies that will be effectively dispersed into the listening area is decreased. The larger the opening, the lower is the maximum frequency that will be effectively dispersed into the listening area. It is the relatively higher frequencies in the direct sound field that allow the listener to localize the musical instruments, vocalists, or other sound sources of a musical performance. Thus, an opening of relatively small width must be used for proper sound localization when using reflected sound in this manner to effectively reproduce the direct sound field. The sound reflected from the wall or walls behind the Reflecting Sound Imaging Speaker Enclosure which does not pass through the opening formed by sub-enclosure 1 and sub-enclosure 2 mounted on base 3 reproduces the reverberant sound field, as described previously herein. The height of sub-enclosures 1 and 2 is at least four inches.

The Reflecting Sound Imaging Speaker Enclosure, as described previously herein, is intended only for monophonic sound reproduction. Stereophonic sound reproduction will require the use of two separate Reflecting Sound Imaging Speaker Enclosures.

Although one detailed embodiment of the invention is illustrated in the drawings and previously described in detail, this invention contemplates any configuration and design of components which will accomplish the equivalent result.

What is claimed is:

1. A loudspeaker arrangement adapted to provide direct and reflected sounds at a desirable ratio with the loudspeaker arrangement disposed adjacent a wall external to the speaker enclosure and disposed between said wall and a listening area, including:

means for producing direct sounds having relatively high, middle and low frequencies, said direct sound producing means including two sub-enclosures mounted on a base and forming an opening between said sub-enclosures such that the most adjacent edges of said sub-enclosures maintain a maximum horizontal distance apart of four inches, along a continuous vertical distance of at least four inches, said sub-enclosures each including acoustic transducers facing so that a portion of the sound waves emanating from said sub-enclosures will reflect from said wall and then pass through the opening formed by said sub-enclosures and by means of diffraction which is caused by the sound waves passing through the opening formed by said sub-enclosures thereby dispersing essentially horizontally into said listening area;

whereby a portion of the sound waves emanating from said acoustic transducers will reflect from said wall and will not pass through the opening formed by said sub-enclosures before reaching said listening area.

2. Speaker enclosure as recited in claim 1, in which the edge of each said sub-enclosure that is most adjacent to the opening formed by said sub-enclosures is substantially straight for a distance of at least four inches.

3. Speaker enclosure as recited in claim 2, in which the edge of each said sub-enclosure that is most adjacent to the opening formed by said sub-enclosures is substantially vertical for a 414dance of at least four inches.

* * * * *